US007524186B2

(12) United States Patent
Brashears et al.

(10) Patent No.: US 7,524,186 B2
(45) Date of Patent: Apr. 28, 2009

(54) LOW EMISSIONS BURNER WITH PREMIX FLAME STABILIZED BY A DIFFUSION FLAME

(75) Inventors: David F. Brashears, Orlando, FL (US); Grover T. Butler, Orlando, FL (US); Joseph T. Mollick, Longwood, FL (US)

(73) Assignee: Gencor Industries, Inc., Orlando, FL (US)

( * ) Notice: Subject to any disclaimer, the term of this patent is extended or adjusted under 35 U.S.C. 154(b) by 1327 days.

(21) Appl. No.: 10/419,164

(22) Filed: Apr. 21, 2003

(65) Prior Publication Data

US 2003/0198909 A1 Oct. 23, 2003

Related U.S. Application Data

(62) Division of application No. 09/651,107, filed on Aug. 30, 2000, now Pat. No. 6,575,734.

(51) Int. Cl.
*F23C 99/00* (2006.01)

(52) U.S. Cl. ..... 431/4; 431/9; 431/10; 431/183; 431/187; 431/278; 431/284; 431/285

(58) Field of Classification Search ..... 431/4, 431/278, 279, 280, 281, 282, 283, 284, 285, 431/2, 3, 5, 6, 7, 8, 9, 10, 11
See application file for complete search history.

(56) References Cited

U.S. PATENT DOCUMENTS

| | | | | | |
|---|---|---|---|---|---|
| 3,273,621 | A | * | 9/1966 | Childree | 431/238 |
| 3,748,080 | A | * | 7/1973 | Dunn | 431/190 |
| 4,257,763 | A | * | 3/1981 | Reed | 431/174 |
| 4,298,337 | A | | 11/1981 | Butler et al. | |
| 4,347,052 | A | * | 8/1982 | Reed et al. | 431/188 |
| 4,530,657 | A | | 7/1985 | Brashears et al. | |
| 4,717,332 | A | * | 1/1988 | Edens | 431/187 |
| 5,235,814 | A | * | 8/1993 | Leonard | 60/738 |
| 5,284,438 | A | * | 2/1994 | McGill et al. | 431/116 |
| 5,359,847 | A | * | 11/1994 | Pillsbury et al. | 60/39.463 |
| 5,361,586 | A | * | 11/1994 | McWhirter et al. | 60/737 |
| 5,441,403 | A | * | 8/1995 | Tanaka et al. | 431/173 |
| 5,451,160 | A | * | 9/1995 | Becker | 431/183 |
| 5,700,143 | A | * | 12/1997 | Irwin et al. | 431/182 |

FOREIGN PATENT DOCUMENTS

| | | | |
|---|---|---|---|
| GB | 2 098 314 | | 11/1982 |
| JP | 0138906 | | 8/1993 |
| JP | 06-18038 | * | 1/1994 |
| JP | 08-135970 | * | 5/1996 |
| JP | 08-296852 | * | 11/1996 |
| WO | WO 98/25084 | * | 6/1998 |

* cited by examiner

*Primary Examiner*—Carl D Price
(74) *Attorney, Agent, or Firm*—Nixon & Vanderhye P.C.

(57) ABSTRACT

A low emissions burner includes a diffusion burner surrounded by an annular array of premix burners. The diffusion burner operates at maximum swirl air flow and at a low constant fuel rate to reduce $NO_x$ emissions. The diffusion burner provides a stable swirling diffusion flame. An annular array of premix burners surrounds the diffusion burner and provides a non-swirling premix flame about the diffusion flame to advantageously provide a higher heat content about the periphery of the burner flame to facilitate industrial drying processes using the burner. The diffusion burner flame maintains the premixed flame stabilized. Water injection nozzles are provided each of the premix and diffusion burners.

13 Claims, 4 Drawing Sheets

LOW EMISSIONS BURNER WITH PREMIX FLAME STABILIZED BY A DIFFUSION FLAME

RELATED APPLICATIONS

This application is a division of application Ser. No. 09/651,107, filed Aug. 30, 2000, now U.S. Pat. No. 6,575,734 the entire content of which is hereby incorporated by reference in this application.

TECHNICAL FIELD

The present invention relates to fuel burners and particularly relates to a low emissions fuel burner e.g. utilized for industrial drying processes.

BACKGROUND

High capacity fuel burners are generally used in industries requiring drying of various materials. For example, such burners are required for operating large rotary aggregate dryers and for kiln drying and processing of lime, sand, bauxite, coal, cement and the like.

In drying aggregate for use in asphalt roads, for example, a fuel burner of this type is employed in conjunction with a rotating drum. Wet aggregate is introduced into one end of the drum and veiled as the drum rotates such that the hot gases emanating from the fuel burner pass through the falling aggregate within the drum, removing the moisture from the aggregate. In a typical installation, the exhaust gases are passed through a baghouse which removes particulates and exhausts the gases to the atmosphere. Environmental considerations, however, require a low pollution emissions burner, particularly a burner providing low emissions of nitrous oxides ($NO_x$). With large-scale burners of this type, the problem of providing low emissions, particularly nitrous oxides, is ongoing. Accordingly, there is a need for a high capacity, low emissions burner for use in industrial processes as described.

DISCLOSURE OF THE INVENTION

In a preferred embodiment of the present invention, there is provided a high capacity, low pollution emissions burner which particularly affords low emissions of nitrous oxides. To accomplish the foregoing, the preferred embodiment of the present invention provides a combination premix and diffusion burner. Particularly, the high capacity burner hereof is provided with a diffusion burner head along the central axis of the burner and which diffusion burner provides high flame stability. While diffusion-type burners typically have substantial $NO_x$ emissions, the present invention combines a diffusion burner and a premix burner such that the diffusion burner operates at reduced capacity and its flame serves primarily to stabilize the premix burner flame during main or high firing. Thus, the diffusion burner affords burner stability throughout the entire operating range of the overall burner. It also operates at a constant fuel rate with maximum swirl air throughput within the capacity of the burner's high pressure fan to cool core portions of the diffusion flame which produce $NO_x$. By lowering the core temperature of the diffusion flame, the $NO_x$ emissions resulting from the diffusion flame are reduced.

The heat output of the burner is advantageously supplied principally by the premix multiple burners. By arranging the premix burners in an array about the central axis of the diffusion burner, the major heat source, for example, for drying aggregate, is displaced away from the centerline of the burner and provides improved aggregate drying. Also, it will be appreciated that premix burners typically have a narrowed stability range in comparison with diffusion burners. Thus, by employing a diffusion burner flame surrounded by multiple premix burner flames, the premix burner flames being stabilized by the diffusion burner flame.

More particularly, the diffusion burner has a burner head including an annular casing or venturi having openings for admitting gaseous fuel into the casing and swirl blades for swirling high pressure air supplied through the casing from a turbofan. The diffusion burner head is surrounded by an array, preferably an annular array, of premix burner heads e.g. sleeves or tubes. Each of the sleeves has a fuel supply conduit and an air supply conduit for receiving high pressure air from the turbofan. Both conduits terminate in outlet ports short of the downstream end of the premix burner sleeve. By angling the exit port of the air supply conduit into the flow of gaseous fuel discharged from the fuel supply conduit, the air and fuel gas are premixed within each premix burner sleeve. Ignition of the premix burner flame occurs generally at the downstream end of the premix burner sleeve. Pressurized air is supplied to the premix air supply conduits from the turbofan via a manifold. Secondary air is provided to the open rearward ends of the premix burner sleeves by a secondary air inlet having an adjustable damper.

In operation, after the diffusion burner is lit, maximum high pressure air is provided within the casing of the diffusion burner to provide maximum swirl energy and afford a cooling of the core of the diffusion burner flame to reduce $NO_x$ production. Notwithstanding this maximum high pressure air, the diffusion flame remains stable and anchored. Once the premix burners are lit by the diffusion flame, stability is provided the premix burner flame by the diffusion burner flame. Burner heat output is controlled by adjusting the secondary air damper supplying low pressure air to the premix burner sleeves and by modulating the fuel supply to the premix burner sleeves. The flow rate of gaseous fuel supplied to the diffusion burner is maintained constant. The fuel gas is also supplied to the diffusion burner head at a reduced rate by using smaller fuel gas admission openings in the annular casing than conventional and which, in conjunction with supplying maximum pressured air during high fire, cools the core temperature of the diffusion flame and reduces $NO_x$ production. Consequently, the overall burner has a high turndown ratio e.g. about 10:1.

In addition, water injection may be optionally provided both the diffusion and premix burners. For example, a water injection nozzle may be provided along the axis of the diffusion burner head to supply a limited quantity of water to the core of the diffusion burner flame. This water injection further cools the flame (in addition to the cooling afforded by maximizing the high pressure air to the diffusion burner) along its high temperature core where a disproportionate quantity of thermal $NO_x$ is produced. Additionally, water injection nozzles are provided about the diffusion burner head between selected premix burner sleeves to cool the premix flame during high fire operation and thereby further reduce $NO_x$ production. Also, an oil nozzle may be provided along the axis of the diffusion burner in lieu of the water injection nozzle for the diffusion burner head. The burner can then be operated solely in a diffusion mode using oil as the fuel or solely in a premix mode using only the array of premix burners and the gaseous fueled portion of the diffusion burner head surrounding the central oil nozzle.

In a preferred embodiment of the present invention, there is provided a low emissions burner comprising a diffusion burner including a casing for receiving air under pressure and having an axis, a swirler for mixing and imparting rotational motion to the air supplied through the casing and a fuel inlet to the casing for providing a stabilized flame downstream of the swirler, a plurality of discrete premix burners surrounding the air supply casing about the axis; each premix burner including a burner sleeve, a fuel supply conduit for supplying fuel into the burner sleeve and an air supply conduit for supplying air under pressure into the burner sleeve, the conduits terminating in outlet ports short of a downstream open end of each burner sleeve enabling premixing of the air and fuel supplied to the burner sleeve via the conduits and providing a substantially premix annular flame downstream of the burner sleeves surrounding and stabilized by the stabilized flame of the diffusion burner.

In a further preferred embodiment hereof, there is provided a low emissions burner comprising a diffusion burner including a casing for receiving air under pressure and having an axis, a swirler for mixing and imparting rotational motion to the air supplied through the casing and a fuel inlet to the casing for providing a stabilized flame downstream of the swirler, a plurality of discrete premix burners surrounding the air supply casing about the axis, each premix burner including a chamber, a fuel supply conduit for supplying fuel into the chamber and an air supply conduit for supplying air under pressure into the chamber, the conduits terminating in outlet ports enabling premixing of the air and fuel supplied to the chamber via the conduits and providing a substantially premix annular flame downstream of the premix burners surrounding the stabilized flame of the diffusion burner; and a water injection nozzle for the diffusion burner for injecting water into the stabilized flame of the diffusion burner to cool the core of the diffusion flame and reduce $NO_x$ production.

In a still further preferred embodiment hereof, there is also provided, in a low emissions burner having a central diffusion burner including a casing for receiving high pressure air, an inlet for supplying fuel to the casing and swirl blades for swirling the air and fuel and an array of premix burners surrounding the diffusion burner each including a burner sleeve, a fuel conduit for supplying fuel to the burner sleeve and a high pressure air conduit for supplying high pressure air into the burner sleeve for premixing with the fuel, a method of operating the burner comprising the steps of maintaining a stabilized diffusion flame by maximizing the high pressure air supplied to the casing and maintaining a constant fuel flow rate to the diffusion burner, stabilizing the premix flame using the diffuser flame; and modulating the flow of fuel to the premix burners while maintaining constant the flow of fuel to the diffusion burner.

BEST MODE FOR CARRYING OUT THE INVENTION

Figure 1:
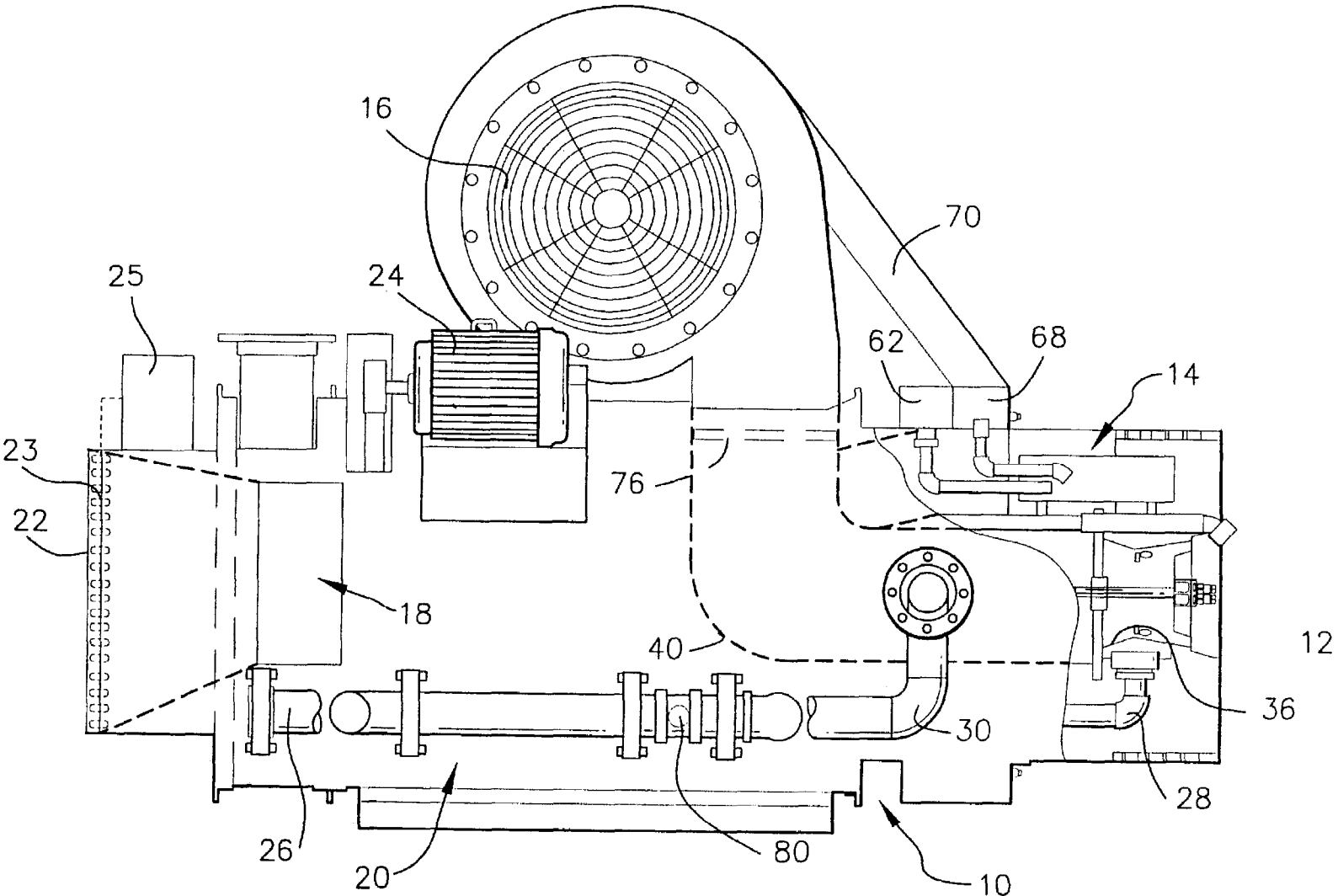
FIG. 1 is a schematic side elevational view of a low emissions burner constructed in accordance with a preferred embodiment of the present invention.

Referring now to the drawings, particularly to FIG. 1, there is illustrated a burner constructed in accordance with the present invention and generally designated 10. Burner 10 includes a diffusion burner, generally designated 12, and a plurality of premix burners, generally designated 14, the latter being arranged in an array about an axis of the diffusion burner, for example, see FIG. 3. Burner 10 also includes a fan, for example, an electrically operated turboblower 16, for supplying air under pressure to both the diffusion burner 12 and the premix burners 14 as set forth below. A low pressure fan 18 is provided in a secondary air duct 20 having an inlet 22 with variably controlled inlet dampers 23 for supplying secondary combustion air to the premix burners, the motor 24 driving the secondary fan 18. Motor 25 adjusts the position of the dampers 23 at the inlet 22 to vary the supplied secondary air. Gaseous fuel is supplied to both the diffusion and premix burners via conduit 26, which splits to provide separate supply conduits 28 and 30 for supplying fuel to the diffusion burner 12 and premix burners 14, respectively.

Figure 2:
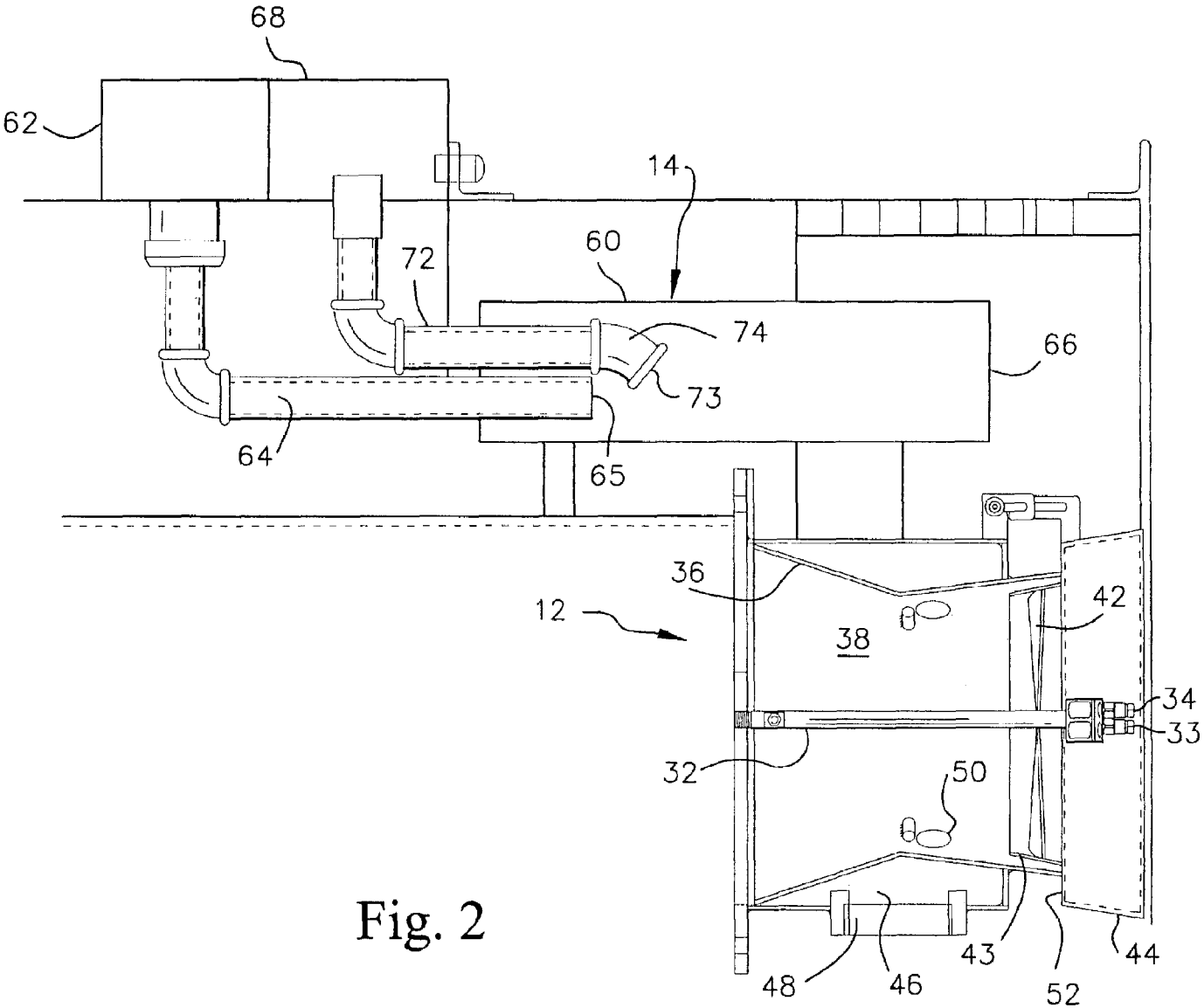
FIG. 2 is an enlarged schematic illustration of a diffusion burner and one of the premix burners.

Referring now particularly to FIG. 2, the diffusion burner 12 includes a water injection system for cooling the diffusion flame comprising a central water supply conduct 32 having a tip 33 comprised of a plurality of water spray nozzles 34 for spraying water into the central core of the diffusion flow. While a plurality of water nozzles 34 are illustrated in FIG. 2, it will be appreciated that any number of nozzles may be used, including a single nozzle to inject the water. Surrounding the water supply conduit 32 and nozzles 34 is a casing 36 forming a venturi 38. As illustrated in FIG. 1, the inlet to the casing 36 lies in communication via duct 40 with air under high pressure supplied by the turbofan 16. At the forward end of casing 36 as illustrated in FIG. 2, there is provided a plurality of generally radially extending swirl blades 42 within a shroud 43 for imparting a swirling motion to the air under pressure supplied through the casing 36 by the turbofan 16. The diffusion burner i.e. burner head 12 also includes an annular plenum 46 which receives fuel gas through an inlet 48 in communication with conduit 28 (FIG. 1). The plenum 46 lies in communication with and supplies fuel gas to the pressurized air flowing within casing 38 via a fuel inlet, e.g. openings 50. Thus, gaseous fuel enters the flow of high pressure air supplied to and within casing 36, flows downstream and is swirled by blades 42 with the air supplied venturi 38 for combustion downstream of the diffusion burner head 12.

Additionally, a stabilization cone 44 lies downstream of the swirl vanes 42. The smaller end of the conically-shaped stabilization cone 44 is larger than the opening of the casing 38 thereby providing an annulus 52 for receiving additional external air as needed for combustion to enter the volume containing the swirling gaseous fuel and air. It will be appreciated that with the foregoing arrangement of the diffusion burner, upon ignition, a diffusion flame is propagated downstream of the swirl blades with the gaseous fuel and air being mixed substantially at the point of ignition in the combustion process generally within the stabilization cone 44.

While the physical size of the burner 12 remains substantially the same as previously constructed burners of this type, e.g. see U.S. Pat. No. 4,298,337, the fuel openings 50 are reduced in size and hence the capacity of the diffusion burner 12 is reduced for reasons discussed below. It will be appreciated that certain ancillary aspects for operating the diffusion burner are not shown, for example, a flame scanner, an igniter for the diffusion burner and other features which are not part of the present invention.

Referring to FIG. 2, the premix burners i.e. burner heads 14 include generally axially directed, elongated premix burner sleeves 60 open at opposite ends. A gaseous fuel supply manifold 62, preferably an annular manifold, extends about the burner 10. A discrete gas fuel supply conduit 64 lies in communication with the manifold 62 and each premix burner 14 for supplying gaseous fuel generally in an axial direction along the burner sleeve 60 and toward the downstream end of the sleeve. As illustrated in FIG. 2, an outlet port 65 of each gas supply conduit 64 terminates short of the forward end 66 of the associated burner sleeve 60. Manifold 62 lies in communication with the gaseous fuel supply conduit 30 (FIG. 1). A manifold 68, preferably annular, lies in communication with air discharged from the turbofan 16 via conduit 70 (FIG. 1) and receives air under pressure from fan 16. A discrete air supply conduit 72 lies in communication with the manifold 68 at one end and with the interior of each burner sleeve 60 at its opposite end in an outlet port 73. An elbow 74 forms part of the outlet port 73 for the air supply conduit 72 in each burner sleeve 60 to direct the pressurized air into the fuel gas exiting the fuel gas supply conduit 64. By directing the pressurized air into the fuel gas, the air and fuel are premixed within the burner sleeve 60 such that premixed air and fuel is supplied through the end 66 of the sleeve 60 for producing a premix flame directly adjacent the end 66 of each premix burner and surrounding the diffusion flame.

In operation, the diffusion burner 12 is first lit using a burner pilot, not shown. After the burner 10 is placed on high fire control, an air damper 76 (FIG. 1) which controls the high pressure air from the turboblower 16 to the air passage 40 and through casing 36 is opened to its maximum capacity i.e. 100% to maximize the air throughput and the swirl imparted to the air as the air passes through casing 36 and the swirl blades 42. By maximizing the swirling air flow and providing a constant rate of fuel gas to the diffusion burner 12 via openings 50, the core of the diffusion flame is cooled to reduce $NO_x$ generated by the diffusion flame. It will be appreciated that even with this high flow air, the diffusion flame is stable. The premix burners 14 are then lit to provide a premix burner flame just forwardly of the outlets 66 of the burner sleeves 60 surrounding the diffusion flame. It will be appreciated that the diffusion burner provides a swirling flame which is surrounded by a premix flame substantially without swirl. Also, and notwithstanding the high air throughput through the diffusion burner from turbofan 16 under high fire operating conditions, the diffusion flame is stabilized and anchored. Further, the reduced size of the fuel openings 50 of the diffusion burner substantially reduces the capacity of the diffusion burner in comparison with the BTU output of the premix burners. Additionally, the fuel gas supplied to the diffusion burner is provided at a constant rate while the supply of fuel gas to the premix burner sleeves 60 is modulated by adjustment to the gas valve 80. With fuel gas flow modulated only to the premix burner 14 and fuel gas supplied at a low constant fuel flow rate to the diffusion burner, the burner 10 has a high turndown ratio. By locating a stable diffusion flame in the center of the premix flame, the stability of the premix flame which is otherwise in a very narrow range is maintained by the diffusion flame. Thus, with high turndown ratio, maximum air supplied to the diffusion burner head and reduced BTU output from the diffusion burner head such that its operation is primarily to maintain the premix burner flame stable, the core of the diffusion flame is at reduced temperature and hence affords reduced $NO_x$ production and hence emissions. Further with water injection into the core of the diffusion flame, additionally reduced temperatures and hence still further reduced emissions are provided. The addition of water injected to the diffusion flame typically lowered $NO_x$ emissions in a range of 16-20% using 0.02 gallons per minute of water per million BTU per hour fuel.

Figure 3:
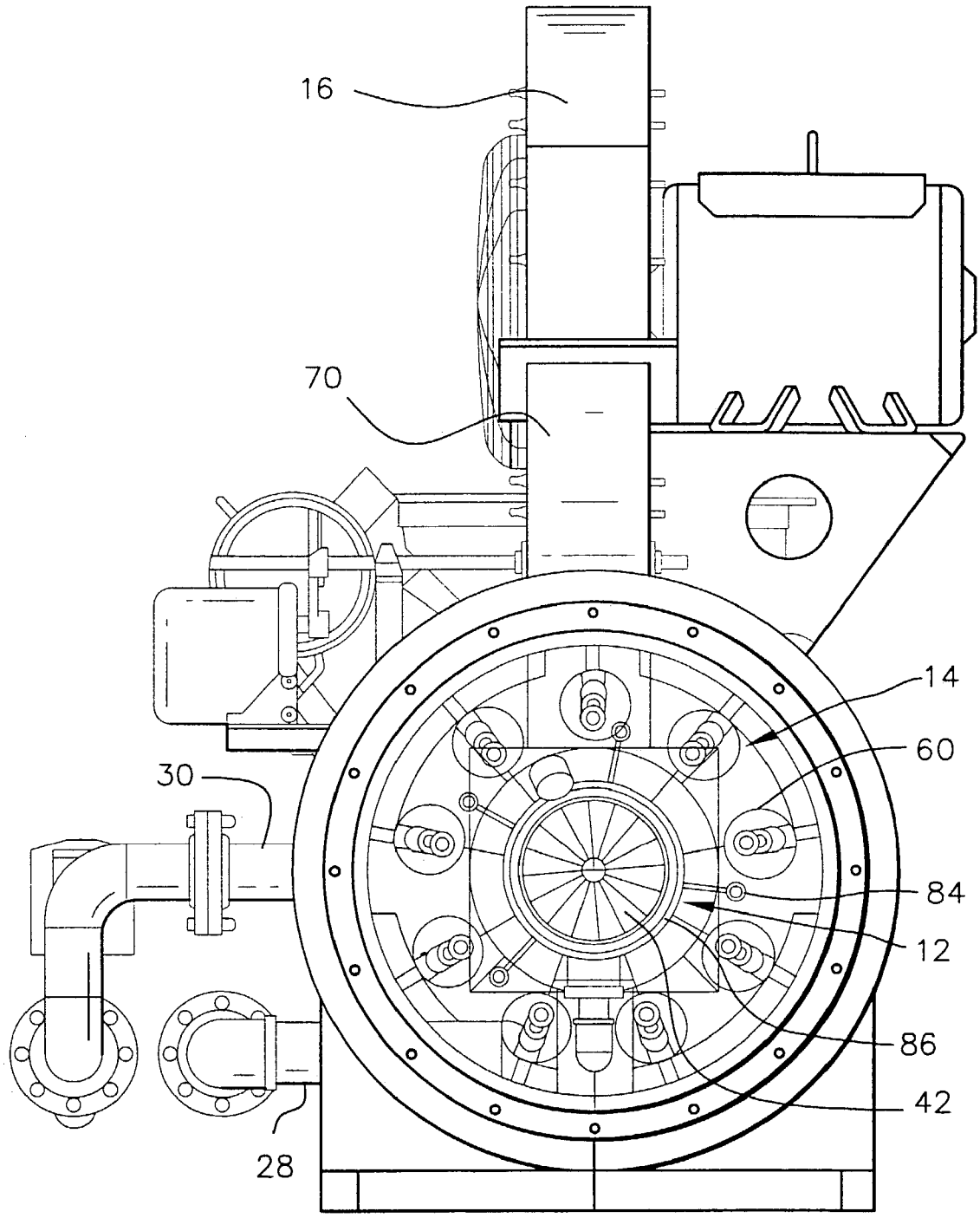
FIG. 3 is an end view of the burner as viewed from right to left in FIG. 1.

To still further reduce the $NO_x$ emissions, the present invention may provide water injection into the premix flame. As illustrated in FIG. 3, water injection nozzles 84 may also be provided for injecting water into the premix flame. Preferably, water injection nozzles 84 are provided in an annular array about the diffusion burner head 12 with a water nozzle 84 disposed between selected adjacent premix burners, e.g. between every other premix burner sleeve 60 to the extent possible. The nozzles 84 are provided water from a common plenum 86 and which water supply may be suitably adjusted by an appropriate valve. Water injection into the premix flame lowered $NO_x$ emissions in a range of 15-20% while using 0.01 gallons per minute of water per million BTU per hour of fuel flow.

Figure 4:
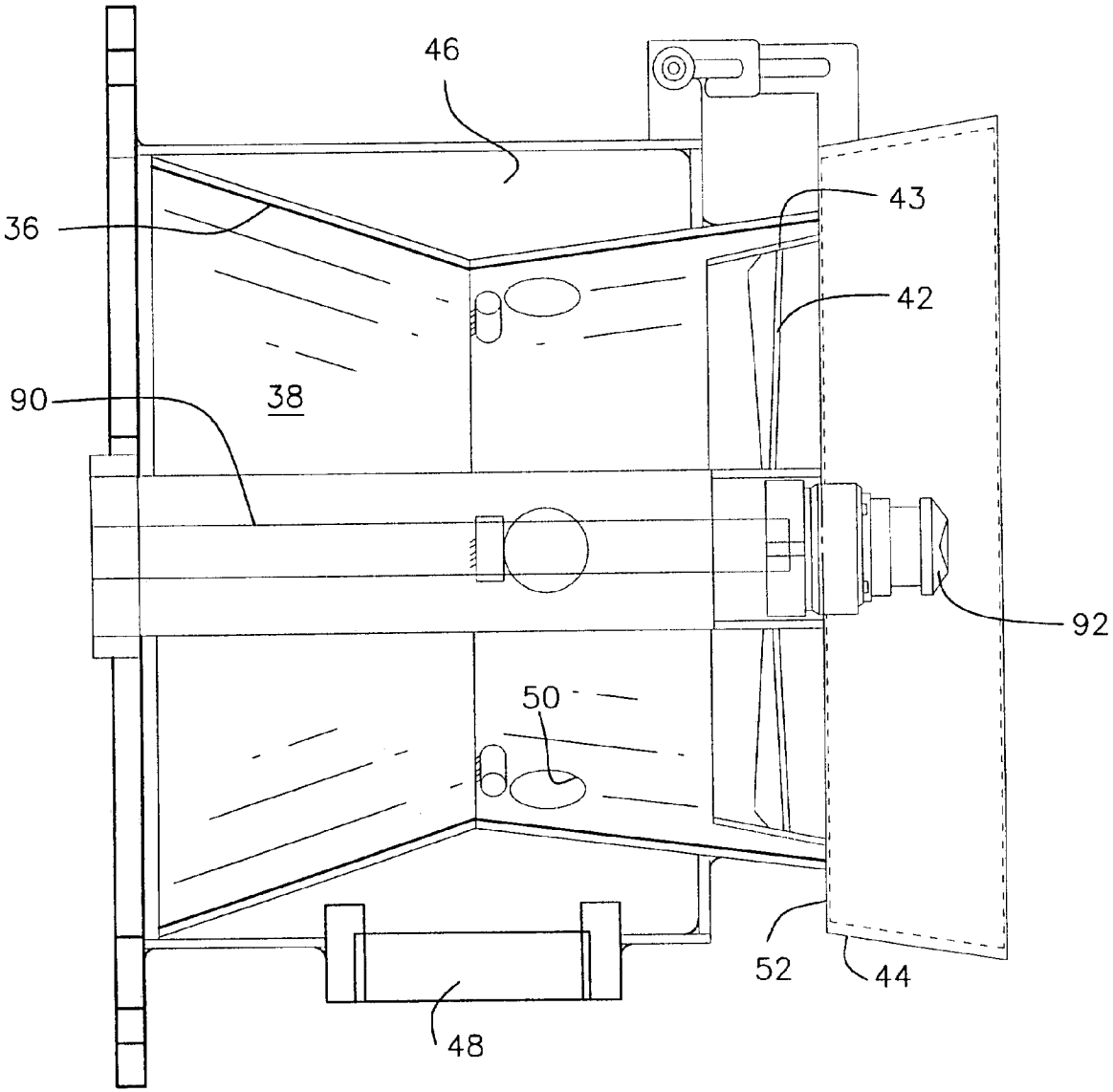
FIG. 4 is an enlarged view of the diffusion burner.

Referring to FIG. 4, the diffusion burner 12 is illustrated without the central water injection nozzles 34. In this embodiment, an oil gun 90 having an oil nozzle 92 may be substituted for the water injection nozzles 34. It will be appreciated that the oil gun 90 is used only as a back-up for the diffusion burner and fuel oil would not normally be burned simultaneously with the gaseous fuel. Thus, both the diffusion burner 12 and the premix burners 14 would be operated as previously described without water injection into the diffusion flame and the oil nozzle would be used only as a back-up and without the premix burners 14.

While the invention has been described in-connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A low emissions burner comprising:

a diffusion burner including a casing for receiving air under pressure and having an axis, a swirler for mixing and imparting rotational motion to the air supplied through said casing and a fuel inlet to said casing for providing a stabilized flame downstream of the swirler;

a plurality of discrete premix burners surrounding said air supply casing about said axis;

each said premix burner including a burner sleeve, a fuel supply conduit for supplying fuel into the burner sleeve, an air supply conduit for supplying air under pressure into said burner sleeve, and a secondary air inlet for supplying air to said burner sleeve in addition to the pressurized air supplied thereto by said air supply conduit;

said fuel supply conduit of each said premix burner terminating in outlet ports short of a downstream open end of each burner sleeve enabling premixing of the air and fuel supplied to the burner sleeve via said fuel supply conduit and providing a substantially premix annular flame downstream of said burner sleeves surrounding and stabilized by the stabilized flame of the diffusion burner.

2. A burner according to claim 1 including a blower in communication with each said air supply conduit for supplying pressurized air to the premix burners.

3. A burner according to claim 1 including a manifold in communication with each said air supply conduit and a blower in communication with said manifold for supplying pressurized air to said premix burners.

4. A burner according to claim 1 including a fan for supplying secondary air to the premix burners upstream of said outlet ports of said fuel and air supply conduits.

5. A burner according to claim 1 wherein said fuel supply conduit supplies fuel generally parallel to an axis of the premix burner sleeve and said air supply conduit supplies air at an angle to said premix burner sleeve axis and into the fuel supplied said burner sleeve by said fuel supply conduit.

6. A burner according to claim 1 including a blower in communication with each air supply conduit for supplying pressurized air to the premix burners and in communication with said air supply casing for supplying pressurized air to said diffusion burner.

7. A burner according to claim 1 including a manifold in communication with and common to at least a plurality of said fuel supply conduits for supplying fuel to said plurality of said fuel supply conduits.

8. A burner according to claim 1 including a valve for modulating the flow of fuel to said fuel supply conduits.

9. A burner according to claim 1 including a manifold in communication with each said air supply conduit and a blower in communication with said manifold for supplying pressurized air to said premix burners, a blower in communication with each air supply conduit for supplying pressurized air to the premix burners and in communication with said air supply casing for supplying pressurized air to said diffusion burner and a manifold in communication with and common to each said fuel supply conduit for supplying fuel to said fuel supply conduits.

10. A burner according to claim 1 including a water injection nozzle for said diffusion burner for injecting water into the stabilized flame of the diffusion burner to cool the core of the diffusion flame and reduce NOx production.

11. A burner according to claim 1 including a plurality of water injection nozzles about said diffusion burner for injecting water into the flame of the premix burners to cool the premix flame.

12. A low emissions burner comprising:

a diffusion burner including a casing for receiving air under pressure and having an axis, a swirler for mixing and imparting rotational motion to the air supplied through said casing and a fuel inlet to said casing for providing a stabilized flame downstream of the swirler, wherein said stabilized flame is provided at a diffusion burner discharge;

a plurality of discrete premix burners surrounding said air supply casing about said axis;

each said premix burner including a chamber, a fuel supply conduit for supplying fuel into the chamber and an air supply conduit for supplying air under pressure into said chamber;

said fuel supply conduit of each said premix burner terminating in outlet ports enabling premixing of the air and fuel supplied to the chamber via said fuel supply conduit and providing a substantially premix annular flame downstream of said premix burners surrounding the stabilized flame of the diffusion burner, wherein said premix annular flame is provided at a premix burner discharge;

said diffusion burner discharge and said premix burner discharge being substantially parallel to each other and in substantially a common plane; and a water injection nozzle for said diffusion burner for injecting water into the stabilized flame of the diffusion burner to cool the core of the diffusion flame and reduce NOx production.

13. A burner according to claim 12 including a plurality of water injection nozzles about said diffusion burner for injecting water into the premix annular flame to cool the premix flame.

* * * * *